US012799416B2

(12) United States Patent
Moghaddam et al.

(10) Patent No.: US 12,799,416 B2
(45) Date of Patent: Nov. 17, 2026

(54) METHOD AND APPARATUS FOR INDUSTRIAL PRODUCTION OF RENEWABLE SYNTHETIC FUELS

(71) Applicant: GIDARA Energy B.V., Schiphol (NL)

(72) Inventors: Elyas M. Moghaddam, Nootdorp (NL); Avishek Goel, Nootdorp (NL); Dobrin Toporov, Nootdorp (NL); Alireza Mohammedi, Nootdorp (NL); Wim van der Zande, Nootdorp (NL); Chris van der Zande, Nootdorp (NL)

(73) Assignee: GIDARA Energy B.V., Schiphol (NL)

( * ) Notice: Subject to any disclaimer, the term of this patent is extended or adjusted under 35 U.S.C. 154(b) by 565 days.

(21) Appl. No.: 18/559,298

(22) PCT Filed: May 6, 2022

(86) PCT No.: PCT/EP2022/062297
§ 371 (c)(1),
(2) Date: Nov. 6, 2023

(87) PCT Pub. No.: WO2022/234093
PCT Pub. Date: Nov. 10, 2022

(65) Prior Publication Data

US 2024/0240094 A1 Jul. 18, 2024

(30) Foreign Application Priority Data

May 6, 2021 (EP) ..... 21172588

(51) Int. Cl.
*C10J 3/78* (2006.01)
*C10J 3/50* (2006.01)
(Continued)

(52) U.S. Cl.
CPC ..... *C10J 3/78* (2013.01); *C10J 3/503* (2013.01); *C10J 3/56* (2013.01); *C10K 1/005* (2013.01);
(Continued)

(58) Field of Classification Search
CPC ..... C10J 2300/0946; C10J 2300/0956; C10J 2300/0959; C10J 2300/093;
(Continued)

(56) References Cited

U.S. PATENT DOCUMENTS 4,274,839 A * 6/1981 Leas ..... B03B 9/06 48/209
8,137,655 B2 * 3/2012 Chornet ..... C10K 1/002 252/373
(Continued)

FOREIGN PATENT DOCUMENTS

AU 2010281841 A1 8/2012
BR 112013031481 12/2016
(Continued)

OTHER PUBLICATIONS

Machine-translation of Office Action for corresponding Brazilian Application No. BR112023023014-4 issued Jun. 19, 2025 (6 pages).
(Continued)

*Primary Examiner* — Imran Akram
(74) *Attorney, Agent, or Firm* — FULLER IP LAW LLC; Rodney J. Fuller

(57) ABSTRACT

The present invention provides a process and apparatus for converting feedstock comprising biomass and/or carbon-containing solid waste material to synthesis gas. The process comprises supplying a densified and pressurized feedstock to a gasifier comprising a fluidized bed zone and a post-gasification zone and contacting the feedstock with a gasification agent. Recovery and purification of the synthesis
(Continued)

gas is then carried out involving the recycling of $CO_2$ back to various stages in the process. The apparatus is configured to carry out the process and comprises transport lines to recycle the $CO_2$. The synthesis gas can be further processed to form renewable synthetic products and/or chemicals.

17 Claims, 2 Drawing Sheets

(51) Int. Cl.
*C10J 3/56* (2006.01)
*C10K 1/00* (2006.01)

(52) U.S. Cl.
CPC ..... *C10J 2300/0906* (2013.01); *C10J 2300/0916* (2013.01); *C10J 2300/0946* (2013.01); *C10J 2300/0959* (2013.01); *C10J 2300/0969* (2013.01); *C10J 2300/0976* (2013.01); *C10J 2300/1631* (2013.01); *C10J 2300/1656* (2013.01); *C10J 2300/1815* (2013.01)

(58) Field of Classification Search
CPC ..... C10J 2300/0976; C10J 2300/0916; C10J 2300/1807; C10J 3/84; C10J 2300/1892; C10J 3/78; C10J 2300/092; C10J 2300/0969; C10J 2300/0973; C10J 3/54
See application file for complete search history.

(56) References Cited

U.S. PATENT DOCUMENTS 10,464,872 B1 * 11/2019 Sirdeshpande ..... C01B 3/12
10,618,818 B1 * 4/2020 Sirdeshpande ..... B01J 21/04
2008/0155899 A1 * 7/2008 Ramamurthy ..... C10K 1/101 48/77
2010/0242353 A1 * 9/2010 Jovanovic ..... B01J 19/0013 422/111
2011/0071229 A1 * 3/2011 Robertson ..... C01B 3/00 422/187
2011/0146978 A1 * 6/2011 Perlman ..... C10J 3/00 166/266
2012/0137583 A1 * 6/2012 Heinritz-Adrian .... C10K 1/004 48/197 R
2012/0247080 A1 * 10/2012 Ishii ..... C10K 1/024 60/39.12
2015/0073188 A1 * 3/2015 Floudas ..... C10L 1/06 422/187
2018/0073430 A1 * 3/2018 Forrest ..... C10K 1/32
2018/0291278 A1 10/2018 Jack et al.
2022/0073829 A1 * 3/2022 Chandran ..... C10J 3/482

FOREIGN PATENT DOCUMENTS

CN 104194839 B * 8/2016
JP 2013189553 A * 9/2013
WO WO2018078661 5/2018

OTHER PUBLICATIONS

Zribi, M. et al., "Hydrogen enriched syngas production via gasification of biofuels pellets/powders blended from olive mill solid wastes and pine sawdust under different water stream/nitrogen atmospheres," International Journal of Hydrogen Energy, vol. 44, Issue 22, Apr. 26, 2019, pp. 11280-11288.
Hanchate et al., "Biomass gasification using dual fluidized bed gasification systems: A review," Journal of Cleaner 1 Production, vol. 280, Part 1, 123148 (4 pages), ISSN 0959-6526 (Sep. 10, 2020).
Examination Report for corresponding Australia Appl. No. 2022268632 issued Oct. 30, 2024, 4 pages.

* cited by examiner

METHOD AND APPARATUS FOR INDUSTRIAL PRODUCTION OF RENEWABLE SYNTHETIC FUELS

CROSS REFERENCE TO RELATED APPLICATIONS

This application is a National Stage of PCT/EP2022/062297, filed May 6, 2022, which claims priority to EP Application Serial No. 21172588.2, filed May 6, 2021, each hereby expressly incorporated by reference in its entirety.

FIELD OF THE INVENTION

The present invention relates to a lower carbon footprint process and apparatus for the conversion of feedstock comprising biomass and/or carbon-containing solid waste material to a more useful synthesis gas product. The conversion is achieved through the use of a gasifier having a fluidized bed and post-gasification zone, wherein economical and environmentally friendly downstream processing of the synthesis product is carried out to purify the synthesis gas product to a pure synthesis gas that can be used to produce a variety of renewable synthetic products and/or chemicals.

BACKGROUND

Waste materials such as municipal solid waste (MSW), agricultural and industrial waste etc. are mainly landfilled and/or incinerated. Currently, waste recycling is gaining more and more attention, since it allows reuse of a large portion of the already used materials, such as paper, some plastics, glass, metals etc. However, other non-recyclable materials are still either dumped into landfills or incinerated in order to recover some of the chemical energy stored in these materials by converting it into electricity and heat. This energy, however, cannot be stored.

There is therefore a need for methods and apparatuses which are able to better process these other non-recyclable materials.

Gasification of biomass and non-recyclable carbon-containing solid waste materials converts waste materials into synthesis gas and thus provides the possibility to convert waste into more valuable products, such as synthetic products and/or chemicals. In other words, gasification of waste helps to recycle the waste materials differently to conventional recycling methods by converting the carbon in the waste materials into more useful molecules (i.e., synthesis gas) which can then be synthesised into valuable final products. Overall, gasifying biomass and waste materials can bring the following advantages to communities: (1) the utilization of carbon containing solid waste materials in an environmentally-friendly process, without emissions of toxic substances into the atmosphere, (2) providing the most efficient way for converting the chemical energy stored in wastes such as municipal solid waste (MSW) into electricity and (3) providing the most efficient way for converting the carbon content of MSW, resp. refuse derived fuel (RDF), into a highly valuable product, such as chemicals or synfuels.

Synthesis gas is typically a fuel gas mixture consisting primarily of hydrogen, carbon monoxide, and very often some carbon dioxide. It is commonly used as an intermediate in creating synthetic natural gas and for producing ammonia or methanol. Synthesis gas (syngas) may be produced by thermochemical conversion of carbon containing sourced materials, such as forest residues, agricultural residues, industrial and urban waste, etc. In general, the gasification of such carbon containing sourced materials provide raw synthesis gas which may include several impurities such as sulfur compounds (mainly hydrogen sulfide, $H_2S$ and carbonyl sulfide, COS), ammonia, chlorine compounds (mainly HCl), volatile matters, lower ($CH_4$, $C_2H_6$, etc.) and high (tar) molecular weight hydrocarbons and fines (mainly in the form of micron and sub-micron fly-ash containing metal salts), and char particles (carbon contained particulates typically above 500 microns). It is desirable to be able to convert, in an efficient process and apparatus, biomass and other carbon-containing solid waste materials into synthesis gas which can then be used to produce high valuable materials and synthetic products/fuels, such as methanol, hydrogen, ammonia, synthetic natural gas and/or Fischer-Tropsch synthesis fuels.

Various approaches have been devised for producing, purifying, and modifying raw synthesis gas from carbonaceous materials. These existing approaches are briefly discussed below.

U.S. Pat. No. 6,063,355 discloses a method for treating waste through two successive fluidized bed and combustion reactors. The solidified and/or slurry waste is introduced to the fluidized bed with revolving flow pattern at a temperature ranging from 450 °C to 650 °C, thereby producing gaseous and carbonaceous materials. These products are directly fed to a swirling flow combustion reactor, which is separate from the fluidized bed reactor, and increasing the temperature to at least 1300 °C to produce synthesis gas. The crude syngas produced in the second reactor is then quenched to separate the slag and the quenched crude syngas is passed through a cyclone and scrubber for further cleaning. This method involves the use of two successive fluidized beds which results in higher capital and operational costs, amongst other inefficiencies.

DE 4317319 A1 discloses a gasification-based technology to produce crude synthesis gas which is further conditioned and used as a feed for alternative end-products such as methanol, cleaned synthesis gas and hydrogen. The shredded wastes are fed to two parallel connected fixed bed gasifiers wherein the feed is reacted with oxygen, steam and raw carbon dioxide at temperatures up to 1200 °C. The produced crude synthesis gas is partly sent to an entrained-flow gasifier at a temperature of 1400 °C and pressure of 26 bar (2600 kPa) and partly to a process chain consisting of washing, heat recovery and cooling stages, followed by a two-stage gas scrubbing unit, COS hydrolysis and lastly used for power generation. The produced crude synthesis gas from the entrained-flow gasifier is further processed in a soot wash unit, followed by CO conversion, gas cooling and scrubbing units and finally used for producing methanol. Again, the use of two parallel fixed bed gasifiers and one entrained flow gasifier results in higher capital and operational costs, amongst having numerous other inefficiencies.

EP 2376607 B1 and EP 2274404 B1 disclose methods for producing and treating crude syngas from biomass through a three-step gasification and reforming process at pressure lower than 10 atm (1013 kPa). The solid biomass is fed to the bottom section, described as a gasification zone, of a fluidized bed reactor in the presence of oxygen and steam, wherein the temperature lies within the range of 500 °C to 750 °C (in the first step). The portion of said oxidized biomass produced in the first step is directly treated in a freeboard region with a residence time lower than 8 s in the presence of oxygen and steam at temperatures ranging from 800 °C to 850 °C (in the second step). The portion of said oxidized biomass produced in the second step is then treated in a separate thermal reformer with oxidizing gas comprising oxygen and steam at a temperature of at least 900 °C and not exceeding a maximum of 1000 °C to produce crude syngas (in the third step). The crude syngas produced in the thermal reformer is then passed through a cyclone, followed by a heat recovery unit and finally scrubbers for further cleaning. This method has a number of disadvantages, such as:

- the third step takes place in a separated thermal reformer apparatus which means that an additional reactor is required, leading to higher capital and operational costs;
- the method is restricted to the operating pressure of the gasifier, which is below 10 atm (1013 kPa). This results in larger gasifier unit sizes being required when processing larger quantities of feedstock;
- due to shorter residence times in the post-gasification zone, heavier hydrocarbons are not completely decomposed and therefore a subsequent separate thermal reforming unit is required (as mentioned above); and
- the reliance on using external catalysts and bed material for gasification increases the operational costs of the system, amongst a number of other inefficiencies.

All of the prior art methods exhibit a number of different disadvantages and there therefore remains a need for processes and apparatuses which are able to convert feedstock comprising biomass and/or carbon-containing solid waste material to synthesis gas in a more efficient, environmentally friendly and cost-effective manner.

In the prior art, various different methods have been tested in order to try to convert biomass and/or waste materials into more useful products, such as synthesis gas—but all of the existing methods have significant drawbacks as explained above. Currently the main methods of preparing syngas from biomass include (1) decentralised pyrolysis of biomass follow by subsequent production of pyrolysis oil, (2) decentralized torrefaction with subsequent production of torrefied biomass and (3) gasification of the biomass/waste. It has now been discovered by the inventors of the present invention that the principles of High Temperature Winkler (HTW) technologies can be adapted in order to provide a process and apparatus that most efficiently converts the carbon from biomass and/or carbon-containing solid waste material into synthesis gas in an environmentally friendly and improved manner. HTW gasification is a long established method performed at elevated pressures and can be described as a pressure-loaded fluidized bed gasification process. The HTW method was used originally for a broad range of applications but, up until now, there have been difficulties in developing existing HTW technologies in order to efficiently convert biomass and/or carbon-containing solid waste materials into synthesis gas. The present invention represents an efficient and environmentally friendly process and apparatus for converting biomass and/or carbon-containing solid waste materials into synthesis gas with a subsequent production of high valuable products, such as chemicals.

US 2018/0291278 A1 discloses multiple stages of reactors form a bio-reforming reactor that generates chemical grade bio-syngas for any of 1) a methanol synthesis reactor, 2) a Methanol-to-Gasoline reactor train, 3) a high temperature Fischer-Tropsch reactor train, and 4) any combination of these three that use the chemical grade bio-syngas derived from biomass fed into the bioreforming reactor.

N. Hanchate, S. Ramani, C. S. Mathpati, V. H. Dalvi, in Journal of Cleaner Production 280 (2021) 123-148, report about biomass gasification using dual fluidized bed gasification systems.

WO 2011/018192 A4 discloses a method for supplying an entrained flow gasification reactor with carbon-containing fuels.

SUMMARY

In a first aspect of the invention, there is provided a process for converting feedstock comprising biomass and/or carbon-containing solid waste material to synthesis gas, the process comprising the following steps:

(a) densifying the feedstock;

(b) pressurizing the densified feedstock in a pressurization unit;

(c) supplying the feedstock from step (b) to a gasifier, optionally a High Temperature Winkler (HTW) gasifier, the gasifier comprising a fluidized bed zone and a post-gasification zone;

(d) converting the feedstock to a synthesis gas product by contacting the feedstock with a gasification agent in the gasifier; and (e) recovering the synthesis gas from the product produced in step (d), wherein recovering the synthesis gas comprises separating at least a portion of $CO_2$ from the product produced in step (d) and recycling at least a portion of the separated $CO_2$ to the pressurization unit and recycling at least another portion of the separated $CO_2$ to the gasifier, thereby improving the overall gasification efficiency of the process.

The process according to the invention provides a simple, relatively low cost and efficient way of converting feedstock comprising biomass and/or carbon-containing solid waste material to synthesis gas. The use of a single gasifier comprising both a fluidized bed zone and post-gasification zone greatly simplifies the process compared with those prior art processes that rely on the use of multiple units e.g., a reactor and a complimentary reformer/combustor.

It has been found that densifying and pressurizing the feedstock prior to it entering the gasifier allows the gasifier to operate at elevated pressures and also provides a feedstock with higher carbon density than shredded or non-pelletized material. The densified feedstock may be in the form of pellets. Optionally, such pellets may be cylindrical and may have a diameter substantially ranging from about 4 mm to 30 mm, in particular from about 4 mm to about 15 mm, more particularly being of a size of about 6 mm, about 8 mm or about 12 mm; and a length substantially ranging from about 8 mm to about 80 mm. Operating the gasifier at elevated pressures is beneficial since it produces a synthesis gas product at elevated pressures. This is useful because the conversion of the synthesis gas into a synthetic product also requires elevated pressures. Compared with a system operating at lower pressures, the present invention represents a considerably energy saving. This is because the pressure required to densify and pressurize the feedstock is considerably less than the additional pressure requirements for compression of synthesis gas produced at a lower gasifier pressure to levels required for conversion into a synthetic product. Thus, the net energy consumption is lower than in the prior art systems not utilizing a densified and pressurized feedstock, which makes the present invention more environmentally friendly.

Furthermore, the ability of this gasification technology to convert biomass and/or solid carbon-containing waste allows an economically advantageous production of synthetic fuels and/or chemicals on industrial scale due to the "economy of scale". The production of such synthetic products requires a certain scale, for instance the capacity of such plant should be higher than 100 MWth.

In the recovery of the synthesis gas from the product, i.e., purifying the synthesis gas product in order to obtain a pure or purer synthesis gas with lower levels of impurities, it has been found that recycle lines can be used in order to return $CO_2$ to the pressurization unit and also to the gasifier. The $CO_2$ is able to act as a pressurizing agent in the pressurization unit and as a gasification agent in the gasifier. The present invention therefore not only recycles the $CO_2$ in the system, but actually reuses it through these transport lines in the thermochemical conversion of the feedstock to the synthesis gas product and in the pressurization of the feedstock. The recycled $CO_2$ is therefore not merely reused as an inert gas but is recycled as a process gas that is, at least partly, converted to syngas (CO) through the Boudouard reaction in the gasifier. This makes the present invention a more environmentally friendly system than existing systems by having a lower carbon footprint.

In an embodiment, step (d) comprises contacting the feedstock with a gasification agent, optionally comprising steam, oxygen and $CO_2$, in the fluidized bed zone at an average temperature of between about 250-500 °C below the ash softening temperature of the feedstock, to partially oxidize the feedstock.

In an embodiment, step (d) comprises contacting the partially oxidized feedstock with a gasification agent, optionally comprising steam, oxygen and $CO_2$, in the post-gasification zone at an average temperature of between about 150-300 °C below the ash softening temperature of the feedstock.

These temperature ranges have been found to result in effective conversion of the feedstock to synthesis gas and also allows flexibility in terms of the other operating conditions in the gasifier, such as pressure. In particular, the present process permits the use of higher pressures, up to approximately 3000 kPa or up to approximately 4000 kPa, which allows the use of small size units and more compacted units for higher product capacity. Furthermore, as mentioned already above, higher gasification pressures are favourable for the downstream processes, such as synthesis of methanol, synthetic natural gas or ammonia from the produced syngas—which all require high pressures. Thus, less energy is required to operate the downstream processes due to the higher pressures of the raw syngas from the gasifier.

In an embodiment, the process further comprises operating the fluidized bed and post-gasification zones at a pressure of between about 200 kPa and about 3000 kPa or about 4000 kPa, optionally about 1000 kPa to about 3000 kPa or to about 4000 kPa, optionally wherein the gasifier is a refractory lined reactor. The advantages of the elevated operating pressures have already been explained herein.

In an embodiment, densifying the feedstock in step (a) takes place in a densification unit, optionally wherein the densifying comprises pelletizing the feedstock in a pelletizer unit. Pelletization has been found to be a particularly advantageous form of densification in the present gasification process. In this respect, it has been found that after crushing and drying a feedstock, it can be difficult to simply introduce the feedstock straight into a system being operated at elevated pressure. This is due to the feedstock's tendency to create bridges and/or holes in the feed bins when transported by gravity. Additionally, in cases where fluff materials are used, due to its low density the amount of pressurizing agent required is large. It was found that pelletization is a highly effective way of avoiding the above problems when the feedstock is introduced into a gasifier operating at such elevated pressures in an economical and efficient way.

In an embodiment, recovering the synthesis gas further comprises:

(e1) filtering and cleaning the product produced in step (d);

(e2) quenching, saturating, scrubbing, and conditioning the product of step (e1); and (e3) treating the product of step (e2) to adjust the ratio of components in the product.

In an embodiment, the product entering the quenching and saturating step has a temperature of at least 150 °C and not greater than 400 °C. It has been found that having the synthesis gas product enter the quenching and saturating units within this temperature range results in particularly effective quenching and saturating of the product.

In an embodiment, quenching and saturating comprises contacting the product with alkaline water having a pH of between about 8 to 11. Treating the product with alkaline water within this pH range has been found to be particularly effective at quenching and saturating the product.

In an embodiment, the product leaving step (e2) has a zero chloride content and has a temperature not greater than about 250 °C.

In an embodiment, recovering the synthesis gas further comprises filtering dust from the product in a dry dust removal unit.

In an embodiment the process further comprises recycling at least a portion of the filtered dust to step (a) (i.e., to the densification unit) and/or recycling at least a portion of the filtered dry dust to step (b) (i.e., to the pressurization unit). These return lines help to achieve a tremendous improvement of the overall conversion efficiency of the system since the returned dust (fly-char) contains a high carbon content which has not yet participated in the gasification reactions.

In a second aspect, there is provided a process for converting feedstock comprising biomass and/or carbon-containing solid waste material to a synthetic product and/or chemical, the process comprising:

converting feedstock comprising biomass and/or carbon-containing solid waste material to synthesis gas according to the process of the first aspect; and converting the synthesis gas to the synthetic product and/or chemical.

In an embodiment, the process further comprises reusing offgas that is produced during the conversion of the synthesis gas to the synthetic product and/or chemical by converting the offgas into synthesis gas and returning the synthesis gas to the step of converting the synthesis gas to the synthetic product and/or chemical. The total amount of synthesis gas entering the system converting the synthesis gas to synthetic product (e.g. methanol synthesis or Fischer-Tropsch synthesis) will be increased and this will lead to an increased production of the final products and thus to improved economy of the process.

In a third aspect there is provided an apparatus for converting feedstock comprising biomass and/or carbon-containing solid waste material to synthesis gas, the apparatus comprising:

a feeding system comprising a densification unit and a pressurization unit;

a gasifier, optionally a HTW gasifier, comprising a fluidized bed zone and a post-gasification zone for thermally converting the feedstock to a synthesis gas product, wherein the feeding system is configured to transport the feedstock to the gasifier; and a processing system downstream of the gasifier configured to recover the synthesis gas from the synthesis gas product, wherein the recovery system comprises at least one $CO_2$ separation unit configured to separate $CO_2$ from the synthesis product;

wherein the processing system further comprises a return line between the at least one $CO_2$ separation unit and the pressurization unit and a second return line between the at least one $CO_2$ separation unit and the gasifier, the return lines being configured to recycle at least a portion of the separated $CO_2$ to the pressurization unit and gasifier, wherein optionally the fluidized bed and post-gasification zones are configured to be operated at a pressure of between about 200 kPa and about 3000 kPa or between about 200 kPa and about 4000 kPa, more optionally between about 1000 kPa and about 3000 kPa or between about 200 kPa and about 4000 kPa.

In an embodiment, the processing system further comprises a dry dust removal unit configured to filter dust from the product and a return line between the dry dust removal unit and the densification unit and/or pressurization unit, the return line being configured to recycle at least a portion of the filtered dust to the densification unit and/or pressurization unit.

The apparatus provides the equivalent advantages that have been explained in relation to the corresponding process features.

The apparatus may incorporate any corresponding apparatus features discussed herein that may be required to carry out any of the process features discussed in accordance with the first and second aspects of the invention.

BRIEF DESCRIPTION OF THE DRAWINGS

Certain embodiments of the present invention are shown in the accompanying drawing and hereinafter described in detail.

DETAILED DESCRIPTION

Figure 1:
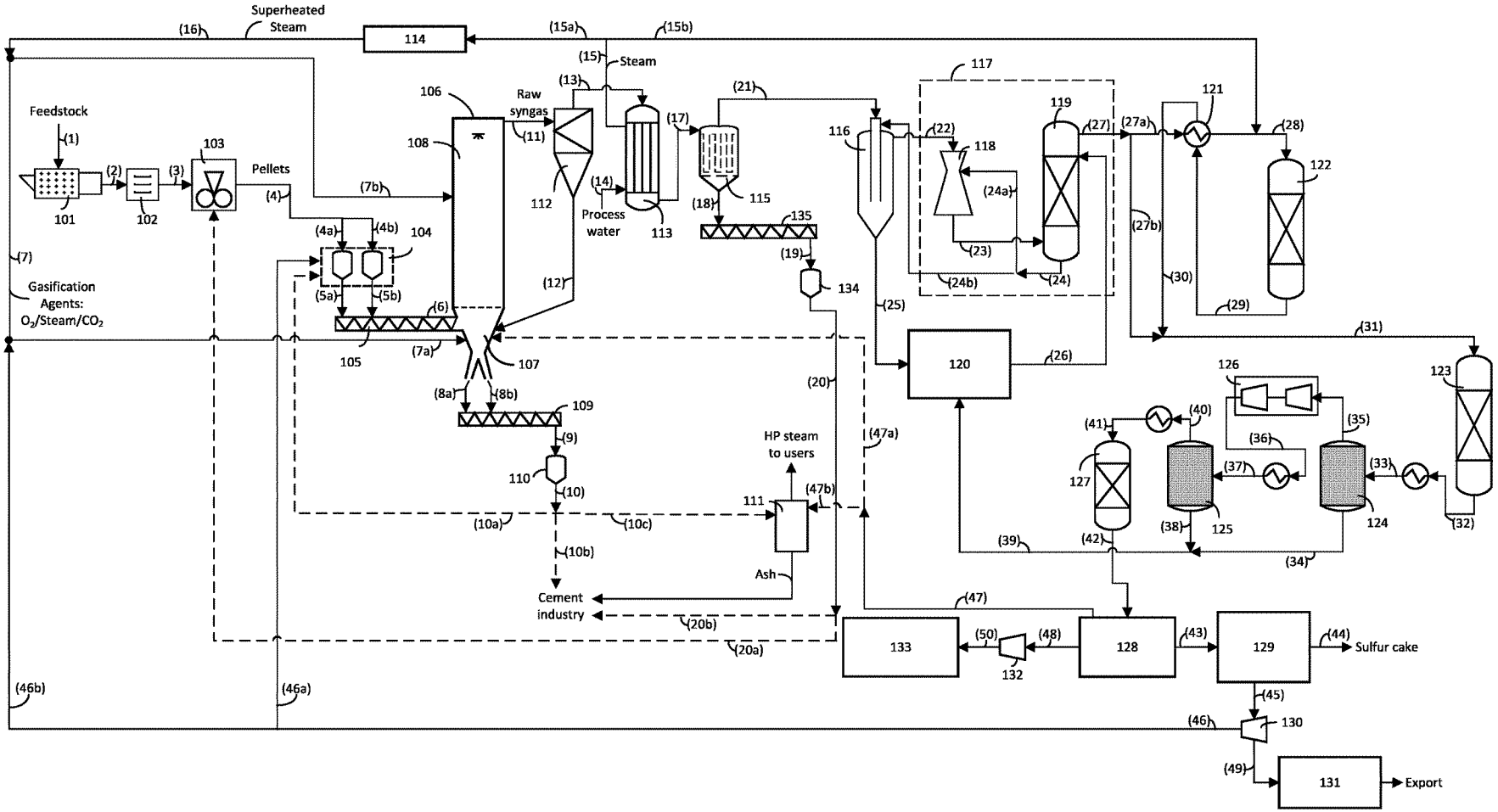
FIG. 1 shows an example process and apparatus arrangement for converting feedstock comprising biomass and/or carbon-containing solid waste material to synthesis gas according to an embodiment of the invention.

Processes and apparatuses having a low carbon footprint for the conversion of feedstock comprising biomass and/or carbon-containing solid waste material to synthesis gas are provided herein and in accordance with the present claimed invention to resolve the foregoing problems in prior art processes and apparatuses.

As used herein "High Temperature Winker" gasification or "HTW" gasification can be described as a pressure-loaded bubbling fluidized bed gasification process. The reactor for carrying out HTW gasification is called "HTW" gasifier. A HTW gasifier is a refractory-lined reactor, typically comprising a fluidized bed zone and a post-gasification zone, such as a freeboard zone, wherein the reactor is equipped with a cyclone separator and recirculation line. A HTW gasifier is typically operated under elevated pressures disclosed herein, such as about 200 kPa to about 3000 kPa or 200 kPa to about 4000 kPa, and temperatures disclosed herein with respect to the present invention. A HTW gasifier is well-known in the art and for example described by S. De et al., Coal and Biomass Gasification—Recent Advances and Further Challenges, Springer Nature Singapore Pte Ltd, published 2018.

As used herein the term "freeboard region" may be understood as the space between an upper surface of the fluidized bed within the HTW under operation and the gas exit at the top of the gasifier.

The term "downstream" as used herein refers to later/further on in the process or apparatus based on the natural flow of the feedstock/syngas through the process/apparatus, and therefore takes its usual meaning in the field.

The term "synthesis gas product" as used herein refers to, unless otherwise explicitly stated, syngas produced through gasification before it has undergone downstream processing and it therefore comprises both syngas and undesirable impurities i.e., a raw syngas.

The term "synthesis gas" as used herein refers to, unless otherwise explicitly stated, syngas after it has undergone downstream processing and it therefore comprises both the syngas and a reduced amount of undesirable impurities i.e., a pure or purer syngas. In certain embodiments, "synthesis gas" refers to a syngas product that has had at least 25 weight percent of the impurities removed, optionally at least 50 wt percent of the impurities removed, optionally at least 75 wt percent of the impurities removed, optionally at least 90 wt percent of the impurities removed, optionally at least 95 wt percent of the impurities removed, optionally at least 99 wt percent of the impurities removed based on the total weight of impurities present in the synthesis gas product prior to downstream processing.

The term "synthetic product" as used herein refers to, unless otherwise explicitly stated, a synthetic fuel, chemical or other desirable product which is obtained from the conversion of synthesis gas, and thus adopts its normal meaning in the art. An example of a method of converting synthesis gas to a synthetic product is the Fischer-Tropsch conversion. An example of a synthetic product is biomethanol. The synthetic product may comprise one main synthetic product or it may comprise a plurality of synthetic products. "Synthetic chemical" as used herein refers to, unless otherwise explicitly stated, to a synthetic product which is a chemical.

The term "return line" as used herein refers to, unless otherwise explicitly stated, a transport line in the system used to transport material upstream i.e., to transport material back to a unit located earlier in the system. Similarly, the term "recycling" as used herein (in conjunction with the return of material within the system and process) refers to, unless otherwise explicitly stated, transporting/returning material to a location upstream in the process i.e., to an earlier step in the process. Usually the recycled material can be reused in the system/process as described herein.

The transportation of material between units/steps in the apparatus/process as referred to herein does not exclude the presence of intermediate units/steps unless otherwise implied, not technically feasible or explicitly stated, for example, through the use of the term "directly". For example, if a return line is located between two units, this does not exclude the possibility of there being an intermediate unit located along the return line unless this is technically not feasible or implicitly/explicitly otherwise stated.

The term "a portion" as used herein refers to, unless otherwise explicitly stated, at least 1 weight percent, optionally at least 10 weight percent, optionally at least 20 weight percent, optionally at least 30 weight percent, optionally at least 40 weight percent, optionally at least 50 weight percent, optionally at least 60 weight percent, optionally at least 70 weight percent, optionally at least 80 weight percent, optionally at least 90 weight percent, optionally at least 95 weight percent, optionally at least 99 weight percent.

An embodiment of the process and apparatus of the present invention is shown in FIG. 1. The figure illustrates an overall schematic of the embodiment wherein a feedstock is gasified to produce low carbon footprint raw syngas which is further subjected to a sequence of process steps including cleaning, conditioning, and modifying through fly-ash/char removal, quenching, scrubbing, adjustment and compression units, whereafter the tar-free and low carbon footprint syngas becomes an appropriate feed for the use in renewable synthetic fuel production.

In FIG. 1, biomass and/or carbon-containing waste material (feedstock) is introduced via line (1) through a crusher machine 101 to fragment the feedstock into smaller fractions. Post-crushing, the hereinabove mentioned fragmented feedstock material is passed through line (2) to drying unit 102, where the material is dried. In drying unit 102, the moisture content present in the feedstock material is evaporated either by natural drying without the use of additional heat or artificial drying with the use of forced flue gas, steam, or air. The crushed and dried carbon-containing material is then transported via line (3) through a pelletizer unit 103, wherein the feedstock material is compacted to produce pellets. It is possible at this stage to premix minor amounts of additives including but not limited to magnesium compounds and some alkali getter materials in order to neutralize impurities such as chlorine, fluorine, sulfur and alkalis which are inherently present in pelletized carbon-containing feedstocks. Generally, such additives can be premixed with the feedstock up to around 3-5% by weight.

The pelletized feedstock is transported via line (4) and then lines (4*a*) and (4*b*) to a feeding system including a series of lock hoppers 104, star feeders (not shown), and then via lines (5*a*) and (5*b*) to feed screw conveyors 105 and introduced into the gasifier 106 through the feeding screw via line (6). The feedstock has a temperature of between about 60 to 80 °C when it is introduced into the gasifier 106. The feedstock is introduced into the fluidized bed zone ("zone" or "reaction chamber") 107 of the gasifier 106.

The pelletized feedstock is contacted with a gasification agent including oxygen, steam and/or carbon dioxide along the fluidized bed zone 107 of the gasifier 106. The gasification agents are introduced into the fluidized bed zone 107 of the gasifier 106 through line lines (7) and (7*a*) via controlled flowrate through single or specialized multilayered nozzles (not shown in FIG. 1), providing an amount effective to partially oxidize and thermochemically decompose the pelletized carbon-containing feedstock to high-quality syngas. Although it is shown in FIG. 1 that the gasification agent is introduced into the gasifier 106 via the fluidized bed zone 107, in reality the gasification agent will be introduced at various different points along the gasifier 106.

The form and amount of gasification agent introduced into the gasifier 106 will depend on the properties of the feedstock to be gasified. Typically the gasification agent is supplied to the gasifier 106 so that the oxygen content in the gasifier 106 is in the controlled range of 0.28-0.52 $Nm^3/kg$ (daf) of the feedstock, of which at least about 20% and not greater than about 80% is supplied to the fluidized bed zone. In further embodiments, the gasification agent is supplied to the gasifier 106 so that the oxygen content in the gasifier 106 is in the controlled range of 0.35-0.45 $Nm^3/kg$ (daf) of the feedstock, of which at least about 35% and not greater than about 65% is supplied to the fluidized bed zone 107. The temperature within the gasifier 106 is achieved through the content, properties and amount of gasification agent added to the gasifier 106. An external heat source does not need to be used and in certain embodiments is not used.

The fluidized bed zone 107 of the gasifier 106, which is located in the conical part with a bubbling fluidized bed regime, embraces bed material containing internally produced solid remnants of gasified carbon-containing feedstock with a particle size distribution ranging from 200 to 1600 microns. The fluidized bed zone 107 operates under controlled conditions, wherein the thermochemical conversion including partial oxidation and thermal decomposition of pelletized feedstock is effected within a temperature range of about 250 to 500 °C below the ash softening temperature of the feedstock and is operated at elevated pressures within the range of about 200 kPa to 3000 kPa. In particular, operation of the gasifier 106 at elevated pressures of more than 1000 kPa facilitates very high production capacity in a compact unit, providing post-processing of syngas at high pressure which results in lower capital and operational costs for typical downstream processing of the synthesis gas towards renewable synthetic products such as bio-methanol. The pelletized feedstock in the fluidized bed zone 106 is partially oxidized and thermochemically decomposed to produce CO and $H_2$, and volatiles of mainly lower molecular weight hydrocarbons together with intermediate species in the form of heterocyclic compounds, light aromatics, light polyaromatic hydrocarbons, entrained fly-ash/char particles, and other solid residues.

Heavy solid residue produced during partial oxidation and thermochemical decomposition settles down at the bottom of the fluidized bed zone 106 and leaves the gasifier through lines (8*a*) and (8*b*) via a bottom product removal unit 109 comprising a series of heat exchangers (intercooled screw conveyers and moving beds etc.) and then through line (9) to lock hopper 110. Furthermore, the heavy solid residues that still contain some carbon, can be sent to either pressurization unit 104 via line (10*a*), the cement industry via line (10*b*), or an auxiliary boiler 111 via line (10*c*) for the generation of high-pressure steam.

In the gasifier 106, the raw syngas including tars, volatiles, and entrained fly ash/char particles produced in the fluidized bed zone 107 rises to the post-gasification zone ("zone" or "reaction chamber) 108 (which is above i.e., downstream from, the fluidized bed zone 107) wherein the raw syngas is further enriched and modified at elevated temperature-controlled along the zone and elevated pressure up to 3000 kPa. More specifically, in the post-gasification zone 108, the entrained partially oxidized and thermochemically decomposed particulate matter is contacted with a controlled rate of gasification agent containing, oxygen, steam, and $CO_2$, providing a controlled temperature range of 150 to 300 °C below the ash softening temperature of the feedstock to keep the particles non-molten along the post-gasification zone 108. Therefore, at these elevated temperatures, the entrained carbon-containing particulate matter is further gasified, thereby increasing the overall carbon conversion ratio. Intermediates such as volatiles, tars, and pyrolytic fly-ash/char carbon fines undergo a thermochemical transformation, steam cracking, reformation, and oxidation and are further converted into raw syngas including CO and $H_2$, enriching the quality of produced raw syngas. The enriched raw syngas is quenched in the topmost section of the gasifier to harden the entrained fine dust particles thereby minimizing the agglomeration problems or deposition in downstream units (cyclone, quencher, scrubber, etc.).

Examples of particular ash softening points of typically feedstocks would be, for example, Refuse Derived Fuels (RDF) with an ash softening point estimated from 1130 to 1230 °C and untreated and hard-wood with an estimated ash softening point ranging from 1150 to 1600 °C. Supply of the gasification agent will be controlled in order to ensure that the relevant zones of the gasifier 106 have the required temperature based on the ash softening point of the feedstock which can be determined prior to processing the feedstock in the system.

The raw syngas product is withdrawn from the gasifier 106 through line (11) and passes through a cyclone 112, in which the majority of the entrained pyrolytic fly-ash/char with a particle size greater than 10 microns is separated from the enriched raw syngas and recycled through line (12) to the fluidized bed zone 107 of the gasifier 106. The synthesis gas product exits the cyclone 112 through line (13) and is passed through a series of raw gas coolers 113 to cool the raw syngas and produce different levels of saturated steam, wherein the process water (added through line (14)) is used as the cooling medium to exchange heat either in co-current or counter-current mode, and thus cooling syngas with a temperature not lower than 250 °C. A part of the produced steam during the heat recovery stage hereinabove described can be superheated in superheater unit 114 and recycled to the gasifier 106 through lines (15), (15*a*) and (16) (followed by lines (7), (7*a*) and (7*b*)) in order to be used either as a basic fluidization agent or together with oxygen in multi-layered nozzles injecting the gasification agent into the gasifier. Some of the steam can be sent via line (15*b*) to the CO shift reactor 122.

The cooled syngas leaves raw gas cooler 113 through line (17) and is further cleaned in a fly-ash/char dry based removal unit 115 (i.e., a dust removal unit), wherein at least a portion of the dust is captured by means of candle filter(s). The filtered dust by-product is then treated in a series of heat exchangers 135 (comprising intercooled screw conveyors and moving beds etc.) and then through line (19) to lock hopper 134. The filtered dust by-product can then be removed from the system and can be reused in the cement industry via lines (20) and (20*b*). The filtered dust by-product can also be returned to the pelletizer unit 103 via line (20) and return line (20*a*) since it still contains carbon, which results in higher overall carbon conversion efficiency of the process. Although not shown in FIG. 1, a further return line may also be included to return the filtered dust by-product to the lock hoppers 104.

The cleaned syngas exits the fly-ash/char dry based removal unit through line (21) and enters the quencher 116 and scrubbing unit 117, wherein the synthesis gas product is saturated and further conditioned. More specifically, the partially cleaned synthesis gas enters the immersion cooler in quencher 116 at a temperature of at least 150 °C and not greater than 400 °C, wherein the synthesis gas is contacted with alkaline water coming from the scrubbing unit 117 through line (24*b*), the alkaline water having a pH of at least 8 and not greater than 11, thereby saturating and quenching synthesis gas. The quenched syngas coming from the immersion cooler enters into a raw syngas scrubbing unit through line (22), wherein the alkaline water at the above mentioned condition, enters venturi scrubber 118 (present within the scrubbing unit) via line (24*a*), and is then passed into a second scrubber 119 (present within the scrubbing unit 117) via line (23). The quenched syngas is treated in these units in order to remove impurities such as fine particles (if any), heterocyclic aromatic compounds, where other contaminants including $H_2S$, COS, $NH_3$, HCN, etc. can also be partially removed. The treated synthesis gas exits the scrubbing unit 117 with almost zero HCl content at a temperature not greater than 250 °C through line (27). The sour water from the quenching unit 116 and scrubbing unit 117 is directed to the waste-water treatment unit 120 through line (25) for further stripping treatment and recycling to the process through line (26).

The quenched, saturated and conditioned syngas is withdrawn from the second scrubber 119 through lines (27) and (27*a*). The temperature is adjusted in economizer unit 121 which is a feed/effluent heat exchanger and the water content of the synthesis gas product is then adjusted by injecting steam via line (15*b*). The synthesis gas then enters the sour CO shift fixed-bed reactor 122 through line (28). To enhance the sour CO shift reaction, a sulfided Co—Mo—K catalyst based on carbon material is used, thereby adjusting the raw syngas for $H_2$ and CO concentration to meet downstream process requirements. The temperature rise in the sour CO shift reactor 122 is such that the adjusted syngas exits the reactor through line (29) at a temperature not greater than 450 °C, through economizer unit 121. The adjusted synthesis gas is further treated in a carbonyl sulfide (COS) hydrolysis unit/reactor 123 after entering through lines (30) and (31), wherein other sour gas impurities including HCN, COS, etc. are transformed into $NH_3$, $H_2S$, etc., facilitating the purification and further modification of adjusted syngas in downstream processing.

The adjusted syngas exits the COS hydrolysis unit 123 at a temperature not greater than 200 °C and enters a series of knockout drums 124, 125 through lines (32) and (33), wherein water, $NH_3$, additional heavy hydrocarbons, and metals, if any, are knocked out. The contaminants removed from the knockout drums 124, 125 are separated through lines (34) and (38) and sent to the wastewater treatment unit 120 through line (39), wherein the wastewater is neutralized, stripped, purified, and recycled back through line (26) to the scrubber unit 119. In between the knockout drums 124, 125, the synthesis gas passes through lines (35), treated in adjusted syngas compression unit 126 and then through lines (36) and (37).

The adjusted synthesis gas is pre-heated (entering through line (40) and via a pre-heater) to obviate possible tar condensation and passed through an activated carbon mercury guard bed 127 (entering through line (41), and then via line (42) the synthesis gas is passed to acid gas removal and tar wash unit 128 where it undergoes an absorption process to remove undesirable impurities and compounds if any. More specifically, the aforementioned absorption process embraces a series of exchangers, absorption columns, and flash drums (not shown in FIG. 1), wherein cold methanol is used as an absorbing agent to clean the entire possible tar content including heterocyclic compounds (e.g., phenol, cresol, quinoline, pyridine), together with light aromatic compounds (e.g., toluene, xylems, ethylbenzene), and light polyaromatic hydrocarbons (e.g., naphthalene, indene, biphenyl, anthracene) together with acid-gas such as $CO_2$ and $H_2S$. The separated heavier hydrocarbons (such as benzene and naphthalene) compounds can be recycled back to the gasifier 106 through lines (47, 47*a*) with the optional destination of an auxiliary boiler (through line 47*b*), thereby increasing the overall thermal efficiency of the full process. The removed acid-gas, which mainly contains $CO_2$ and $H_2S$, is sent through line (43) to a $CO_2$ and $H_2S$ separation unit 129 wherein sulfur is separated and removed in the form of elemental sulfur cake through line (44). The separated $CO_2$ is passed to a $CO_2$ compression unit 130 through line (45), thereby increasing the pressure of $CO_2$ up to 3000 kPa or up to 4000 kPa, and is partially recycled back to the process for use as a pressurizing agent in the pressurization unit i.e., lock hoppers 10 through return line (46, 46*a*) and as a gasification agent in the fluidized bed zone 107 of the gasifier 106 through return line (46, 46*b*), thereby ensuring that the process has low-carbon footprint, is environmentally friendly and cost-efficient. Some of the $CO_2$ may be passed through line (49) in order to be treated in bio-$CO_2$ liquefaction unit 131, and then exported.

The adjusted, purified synthesis gas is withdrawn from the acid-gas removal and tar wash unit 128 through line (48) and passed through a compressor/pressure booster unit 132, wherein the pressure is elevated from about 5000 kPa to 10000 kPa which is a favorable condition for the use of cleaned tar-free synthesis gas as feedstock to prepare renewable synthetic products such as methanol in synthetic product production unit 133, such as a 2nd generation biofuel synthesis unit, via line (50).

The process and apparatus of the invention will now be described in further detail.

The process and apparatus of the invention can generally be separated into three main stages:

(1) Pre-gasification—i.e., preparation of the feedstock and processing of the feedstock prior to it entering the gasifier.

(2) Gasification—i.e., gasification of the feedstock in the fluidized bed zone and post-gasification zone of the gasifier.

(3) Downstream processing—i.e., treatment of the raw synthesis gas product produced in the gasifier. This generally includes any processing of the synthesis gas product after it has left the gasifier. The raw synthesis gas product is usually treated to optimize it and remove impurities in order to obtain a pure or purer synthesis gas.

After the downstream processing, the pure synthesis gas may undergo further treatment in order to convert it into synthetic products or chemicals.

Pre-Gasification

In accordance with the present invention, pre-gasification includes densifying the feedstock, optionally in a densification unit, then pressurizing the densified feedstock in a pressurization unit, followed by supplying the densified and pressurized feedstock to the gasifier, optionally to the fluidized bed zone of the gasifier.

The process and apparatus herein may include any other pre-gasification steps or units known to typically be used in combination with a HTW gasifier or other suitable gasifiers.

One of the first steps in the pre-gasification process is that the feedstock must be provided.

Any suitable feedstock comprising biomass and/or carbon-containing solid waste material is suitable to be processed in the process of the present invention. In alternative embodiments the feedstock comprises biomass. In an alternative embodiment the feedstock comprises a carbon-containing solid waste material. In some embodiments the feedstock comprises only biomass, in other embodiments only carbon-containing solid waste material and in further embodiments comprises a blend of biomass and carbon-containing solid waste material. In certain embodiments, the feedstock comprises a majority (i.e., greater than 50 weight percent) of biomass or the feedstock comprises a majority of carbon-containing solid waste material. In certain embodiments, the feedstock comprises only biomass and carbon-containing solid waste material i.e., the feedstock is biomass and carbon-containing solid waste material. In certain embodiments the feedstock comprises a majority of biomass and carbon-containing solid waste material. In certain embodiments, the feedstock comprises biomass, carbon-containing solid waste material or a combination of biomass and carbon-containing solid waste material in an amount of at least 10 weight percent, at least 20 weight percent, at least 30 weight percent, at least 40 weight percent, at least 60 weight percent, at least 70 weight percent, at least 80 weight percent, at least 90 weight percent, at least 95 weight percent or at least 99 weight percent based on the total weight of the feedstock.

The process of the present invention is able to process homogenous and heterogeneous feedstocks. In certain embodiments the feedstock is a homogenous feedstock. In other embodiments the feedstock is a heterogeneous feedstock. The term "homogenous feedstock" refers to single-sourced material e.g., trees, agricultural residues, wood chips. "Heterogeneous feedstock" refers to multi-sourced materials e.g., materials such as wood residues from sawmills, textiles, paper, plastic, cardboard, hydrocarbon compounds and contaminants compounds. The feedstock ultimately may comprise one single type of feedstock, or multiple different types of feedstocks or one main feedstock with minor components constituting other feedstocks.

Biomass refers to materials typically classed as biomass i.e., organic matter, and takes its usual meaning in the art. Examples of biomass that may be used in the invention are wood and plants. Carbon-containing solid waste material is defined as any form of solid waste which comprises material that is carbon-containing, and therefore takes its usual meaning in the art. Examples of carbon-containing solid waste include wastes such as wood waste, agricultural waste, municipal solid waste (MSW), refuse derived fuels (RDF), dried sewage sludge and industrial waste. The above materials may be processed in the invention alone or in combination with one another in a blend. Possible feedstocks include: RDF, MSW, waste wood (optionally untreated) and hard wood, all of which may be processed alone or in combination with one another. In particular, suitable feedstocks may be selected from RDF alone, MSW alone, RDF and MSW blend, RDF with plastic, untreated wood and hard wood. Particularly suitable is the use of an RDF and MSW blend. "Carbon-containing" means that the waste material contains at least some carbon. In certain embodiments, the carbon-containing solid waste material comprises at least 25 weight percent carbon, at least 35 weight percent carbon or at least 50 weight percent carbon (i.e., a majority carbon) based on the total weight of the carbon-containing solid waste material. The term "waste" takes its usual meaning in the art such as that the material is unwanted and/or unusable.

Various different feedstocks that comprise biomass and carbon-containing solid waste material, and in various different forms, are suitable feedstocks in the present process.

It has been found particularly advantageous to densify the feedstock prior to it being supplied to the gasifier in a densification unit. Any known densifying or densification technique/method may be used herein to densify the feedstock. One such densification method is pelletization in a pelletization unit. Any suitable pelletizing method and apparatus known in the art may be used. The use of a pelletized material is not only favourable for gasification processes at elevated pressures but also provides a feedstock with higher bulk density than shredded or non-pelletized material. The use of pelletized flow material facilitates operation at high pressures achieving two main advantages, namely the higher feed density leads to lower $CO_2$ consumption which is advantageous for the process and improving the flowability of the feed material which can be important when using lock hopper gravity system for pressurization. Furthermore, there is a possibility to return carbon-containing dust to the pelletization unit, removed from the process in a dry dust removal unit, the return of which increase the overall carbon conversion efficiency of the system. There is also a possibility to premix minor amounts of additives into the pellets including but not limited magnesium compounds to neutralize impurities such as chorine, fluorine and sulphur which are inherently present in pelletized carbon containing material.

Another pre-gasification step is to pressurize the densified feedstock in a pressurization unit. For the avoidance of doubt herein, "pressurize" refers to increasing the pressure. The pressurization step may take place in any suitable pressurization unit that is capable of increasing the pressure of the feedstock. For example, a lock hopper system may be used comprising a single lock hopper or several lock hoppers. Any suitable pressurization agent may be used to pressurize the feedstock. In some embodiments, the pressurization agent comprises $CO_2$. In certain embodiments, the pressurization agent comprises $CO_2$ which has been separated from the synthesis gas product in a $CO_2$ separation unit and recycled/returned from a downstream processing unit. This helps to improve the carbon footprint, environmental friendliness of the process and also make the process more cost-effective, as explained hereinbefore. The recycling of the $CO_2$ to the pressurization unit (or more generally the feeding system) also helps to enable the feeding system to operate at a similar pressure to the gasifier. Dust separated from the synthesis gas product in a dry dust removal unit downstream of the gasifier may also be recycled/returned to the pressurization unit in order to be reprocessed, which improves the overall carbon conversion efficiency of the process. In certain embodiments, the pressure in the pressurization unit is between 1000 to 3000 kPa, optionally 1500 to 2500 kPa. In certain embodiments, the pressure in the pressurization unit is the same or similar to the pressure of the gasifier.

The pressurization unit and densification unit generally form what is known as the feeding system and the feeding system may include any other steps or units known in the art to be used in feeding systems such as, for example, star feeders, crusher units and drying units. The pressurization unit may also typically be referred to in the art as a feed handling unit.

It should be noted that further steps/processing of the feedstock may take place in between the densification and pressurization steps. In some embodiments however, the pressurization will take place directly after the densification of the feedstock.

The pre-gasification process and apparatus then includes means suitable for supplying the densified and pressurized feedstock to the fluidized bed zone of the gasifier, such as a feed screw conveyor as will be readily understood in the art.

Gasification

In accordance with the present invention, the gasification comprises gasifying the feedstock with a gasification agent, provided in sufficient quantities, in a gasifier comprising a fluidized bed zone and a post-gasification zone downstream of the fluidized bed zone, in order to convert the feedstock to a synthesis gas product.

Any suitable gasification agent known in the art may be used. In certain embodiments, the gasification agent comprises oxygen, steam and $CO_2$. In certain embodiments, the gasification agent further comprises any other suitable gasification agent. In certain embodiments the gasification agent further comprises air. In certain embodiments, the gasification agent is oxygen, steam and $CO_2$ i.e., the gasification agent does not comprise any other substantial gas (with the exception of impurities). The gasification agent is fed into the fluidized bed zone of the gasifier using any suitable feeding means. In certain embodiments, the gasification agent comprises $CO_2$ recycled from a downstream $CO_2$ separation unit. In certain embodiments the $CO_2$ is recycled to the fluidized bed zone of the gasifier.

In certain embodiments, the gasification agent is introduced into the gasifier via a controlled flowrate, optionally through a single or multilayered nozzle system, as is described in more detail herein.

In some embodiments, the content of the gasification agent and the amount of gasification agent introduced into the gasifier will depend on the identity of the feedstock and its characteristics and properties. In some embodiments, this includes properties of the feedstock such as the fixed carbon content, heating value, ash melting point, and metal content and other impurity levels. In certain embodiments, the content and amount provided should be sufficient to partially oxidize and thermochemically decompose the feedstock to high quality, tar free syngas, as will be understood in the art. Ultimately, in certain embodiments the gasification agent is selected so as to be sufficient to convert the feedstock to the synthesis gas product.

In certain embodiments, subject to the specific feedstock that is used in the process, the gasification agent is supplied to the gasifier so that the oxygen content in the gasifier is in the controlled range of 0.28-0.52 $Nm^3/kg$ (daf) of the feedstock, of which at least about 20% and not greater than about 80% is supplied to the fluidized bed zone. In further embodiments, the gasification agent is supplied to the gasifier so that the oxygen content in the gasifier is in the controlled range of 0.35-0.45 $Nm^3/kg$ (daf) of the feedstock, of which at least about 35% and not greater than about 65% is supplied to the fluidized bed zone.

daf or DAF=Dry Ash Free content, the weight percentage from the dry and ash free material, is calculated as follows:

$$daf = 100/(100 - TM - \text{ash})$$

where, TM=total moisture content of the feedstock, ash=ash content in the feedstock. TM is calculated using ISO 18134-1 and ash content using ISO 18122 standard.

In certain embodiments, subject to the specific feedstock that is used in the process, the gasification agent is supplied to the gasifier so that the amount of steam in the gasifier is in the controlled range of 0.23-0.52 $Nm^3/kg$ (daf) of the feedstock, of which at least about 40% and not greater than about 80% is supplied to the fluidized bed zone. In further embodiments, subject to the specific feedstock that is used in the process, the gasification agent is supplied to the gasifier so that the amount of steam in the gasifier is in the controlled range of 0.30-0.45 $Nm^3/kg$ (daf) of the feedstock, of which at least about 50% and not greater than about 70% is supplied to the fluidized bed zone.

The gasifier, typically a HTW gasifier, comprises a fluidized bed zone and a post-gasification zone i.e., both zones are present in a single reactor (i.e., gasifier). The fluidized bed zone is below the post-gasification zone i.e., the post-gasification zone is downstream of the fluidized bed zone. A fluidized bed zone takes its usual meaning in the art and in HTW gasification, namely a bed of material in which the properties during operation are such that the material therein behaves as a fluid. In certain embodiments, the bubbling fluidized bed includes internally produced solid remnants of gasified feedstock, termed here as bed material. In general, the bed materials have a particle size ranging from about 200 to about 1600 microns.

The post-gasification zone as referred to herein also takes its usual meaning in the art and in HTW gasification. In certain embodiments, the post-gasification zone is a free-board zone.

In certain embodiments the gasifier comprises a conical portion. In certain embodiments, the fluidized bed zone is located within the conical portion and the post-gasification zone is located within the non-conical portion above the conical portion. In certain embodiments, the conical portion is angled between 3 and 12 degrees. Having the fluidized bed zone situated in the conical portion allows nearly constant gas velocity and uniform oxygen supply across the height of fluidized bed with the advantage of controlled process conditions leading to homogeneous bubble formation in the fluidized bed zone which enhances thereby partial oxidation and thermal decomposition of the feedstock. Alternatively, the gasifier may take any suitable gasifier shape and/or form. In certain embodiments, the gasifier is a refractory lined gasifier.

In certain embodiments, the operating temperatures of the gasifier are dependent on the ash softening temperature of the feedstock to be gasified. Therefore, in certain embodiments the ash softening temperature of the feedstock to be gasified is measured prior to operating the gasifier.

"Ash softening temperature" takes its usual meaning in the art, namely the temperature at which particles of ash obtained from the feedstock will begin to deform (i.e., soften) or fuse. Ash softening temperature when referred to herein is measured experimentally using the standard method CEN/TS 15370-1.

The ash softening temperature of some example feedstocks at reducing atmosphere condition are provided below:

| Feedstock type | Ash softening temperature (° C.) |
|---|---|
| Mix of refuse derived fuels (RDF) and municipal solid waste (MSW) | 1178 |
| MSW | 1180 |
| RDF with plastic | 1130 |
| Untreated wood | 1372 |
| Hard wood | 1456 |

The above values are taken from particular feedstocks which have been tested. In general, RDF will have an ash softening temperature ranging from 1130 to 1230 °C and typical untreated and hard-wood from 1150 to 1600 °C, although impurities therein can result in ash softening temperatures falling outside of these ranges. The temperature ranges are therefore merely provided as approximate ranges.

In certain embodiments, operating the gasifier at temperatures based on the ash softening temperature of the feedstock results in a highly efficient conversion of the feedstock to synthesis gas. Operating the process within these temperature ranges has been found to advantageously avoid melting the ash in the gasifier and the particles becoming sticky, which can lead to agglomerations that damage the fluidized bed.

The biomass and/or carbon-containing solid waste material feedstock (as discussed in detail earlier) is supplied to the gasifier (by means discussed in detail earlier), in certain embodiments in a pelletized form. In certain embodiments, the feedstock is supplied to the gasifier in the fluidized bed zone i.e., via an entry point in the fluidized bed zone. In certain embodiments the feedstock is supplied to the gasifier at up to 3 different entry points within the fluidized bed zone. In certain embodiments there are 3 entry points, in other embodiments 2 entry points and in further embodiments only 1 entry point.

In certain embodiments, the gasification agents are supplied to the gasifier at multiple locations along the gasifier. In certain embodiments, the gasification agent is supplied to both the fluidized bed zone and the post-gasification zone of the gasifier. In certain embodiments, the gasification agent is supplied to the gasifier at approximately 2 to 15 locations along the gasifier, optionally 4 to 10 locations, optionally 5 to 8 locations along with the gasifier.

In certain embodiments the gasification agent is supplied to the gasifier via a plurality of nozzles. In certain embodiments, the nozzles are located at multiple locations along the gasifier. In certain embodiments, the gasification agent is supplied to the gasifier at approximately 2 to 15 locations along the gasifier, optionally 4 to 10 locations, optionally 5 to 8 locations along the gasifier. In certain embodiments at least one of the nozzles is arranged on the side of the gasifier, although it is also possible for the nozzles to be located at the base/bottom of the gasifier. A combination of nozzles located at the bottom of the gasifier and at the sides of the gasifier is also possible.

In certain embodiments, each of the nozzles are multi-layered. In certain embodiments, at least one of the nozzles is arranged at an acute angle relative to a horizontal plane of the gasifier. In certain embodiments, the nozzles are tuyeres or lances although any suitable nozzle may be used. In certain embodiments, the nozzle is multi-layered as described in EP 2885381 A1. In this document multi-layered nozzles are described which have at least three mutually coaxial pipes, each of which delimits at least one annular gap. The outermost pipe is designed to conduct superheated steam and has a steam supply point, the central pipe is designed as an annular gap, and the innermost pipe is designed to conduct oxygen at a temperature of no higher than 180 °C and has an oxygen supply point. A temperature sensor is arranged within the innermost pipe, said temperature sensor extending to just in front of the opening of the innermost pipe. The innermost pipe tapers in the form of a nozzle before opening; the innermost pipe opens into the central pipe; and the opening of the central pipe protrudes further relative to the opening of the outermost pipe. Thus the nozzles have a "multilayer" structure i.e., a plurality of pipes arranged coaxially to one another.

In certain embodiments, the nozzles are configured to supply in use the gasification agent so as to generate both the required fluidisation inside the fluidized bed zone and to generate a plurality of operating temperatures within the fluidized bed and post-gasification zones of the gasifier i.e., a plurality of temperature subzones within the fluidized bed and post-gasification zones.

In certain embodiments, at least one of the nozzles is arranged at an acute angle relative to a horizontal plane of the gasifier i.e., it is set at an angle relative to or away from both the horizontal plane. The term "acute angle" used herein takes its normal meaning which is less than 90 degrees and more than 0 degrees. The horizontal planes are defined in the normal manner in relation to a gasifier, namely the planes perpendicular to the vertical axis of the gasifier (the vertical axis being that defined from the bottom to the top of the gasifier).

In essence, the at least one nozzle is configured at an angle orientated away from a horizontal plane of the gasifier (at an angle above or below relative to the horizontal plane are both possible). In certain embodiments the at least one nozzle may also be arranged at an acute angle relative to a vertical plane or axis of the gasifier. In certain embodiments, the nozzle is arranged at an angle between 5 to 85 degrees relative to the horizontal plane, optionally at an angle between 10 to 80 degrees relative to the horizontal plane or between 20 to 60 degrees relative to the horizontal plane.

It has been found that arranging the nozzles at an angle relative to the horizontal plane of the gasifier, as well in certain embodiments using the described nozzle arrangements and multilayer configuration, enhances localized transport and reaction mechanisms along the gasifier. This owes to the gasification agent being introduced at an acute angle relative to the horizontal plane of the gasifier. In particular, the angle of the nozzles provides advantages in relation to the flame (jet). Whenever oxygen (i.e., the gasification agent) is injected into the gasifier, there is a flame observed at the outlet of the injection nozzle. The length of the flame should not exceed the inner radius (half of the inner diameter) of the gasifier vessel. This is to avoid any kind of contact between the flame tip from the injection nozzle and a lining of the gasifier such as a refractory lining (on the other side). Therefore, the nozzles of the invention are able to have longer flame lengths which help to enhance the cracking of high molecular weight hydrocarbons such as naphthalene—as compared with typical nozzles which are arranged in a horizontal plane of the gasifier and typically inject the gasification agent along a substantially horizontal plane into the gasifier. Naphthalene is undesirable in the product synthesis gas and thus the quality of the synthesis gas product is improved.

In certain embodiments, the gasifier is operated at pressures ranging from about 100 to about 3000 kPa or to about 4000 kPa, optionally about 1000 to about 2000 kPa, optionally about 1100 to about 1700 kPa, optionally about 1200 to about 1400 kPa. In certain embodiments, the elevated pressure enables a very high production capacity in a compacted unit. In certain embodiments the operating pressure in the gasifier is higher than about 1000 kPa. In some embodiments, having an operating pressure higher than about 1000 kPa facilitates the post-treatment and post-processing of the synthesis gas at high pressure resulting in lower capital cost for typical downstream processing of the synthesis gas towards advanced fuels such as bio-methanol.

In certain embodiments, the feedstock is contacted with a gasification agent comprising oxygen, steam and $CO_2$ in the gasifier at the following temperatures in the gasifier:

(a) supplying the feedstock to a gasifier, the gasifier comprising a fluidized bed zone and a post-gasification zone (b) between about 350-400 °C below the ash softening temperature of the feedstock to partially oxidize the feedstock in the fluidized bed zone;

(c) then at least a portion of the product of step (b) is treated at a higher temperature, the temperature being between about 250-350 °C below the ash softening temperature of the feedstock, in the fluidized bed zone;

(d) then at least a portion of the product step (c) is treated at a higher temperature, the temperature being between about 200-300 °C below the ash softening temperature of the feedstock, in the post-gasification zone;

(e) then at least a portion of the product of step (d) is treated at a higher temperature, the temperature being between about 150-250 °C below the ash softening temperature of the feedstock in the post-gasification zone.

In certain embodiments, each of the above steps takes place substantially in a different subzone within the gasifier. Subzone referred to in this context refers to a zone within the fluidized bed or post-gasification zones. In certain embodiments, each subsequent step takes place in a subzone located above the subzone of the previous step within the gasifier i.e., each step takes place progressively higher up within the gasifier as the feedstock rises from up the gasifier from the fluidized bed zone to the post-gasification zone until it exits the gasifier (progressively downstream). In certain embodiments, in the gasifier, the temperature generally increases from bottom to top of the gasifier as is usual in the art. It shall be understood that there will likely be some overlap in temperatures around the borders of each subzone and hence the use of the term "substantially" above. Similarly, it will be understood that there may be some similar overlap between the fluidized bed and post-gasification zones.

In certain embodiments, there is at least a 5 °C, or 10 °C, or 20 °C, or 30 °C, or 50 °C increase in temperature between each subzone.

In certain embodiments, the above temperature or thermal subzones within the gasifier are generated through the controlled addition of the gasification agent. That is to say that in certain embodiments, no external heat source is used. In contrast, in the certain embodiments the gasification agent, comprising oxygen, steam and $CO_2$, is injected into the gasifier in sufficient form and amount to generate the plurality of thermal subzones. In further embodiments, the gasification agent is injected into the gasifier in a sufficient form and amount to effectively oxidize the feedstock and convert it into the synthesis gas product. In further certain embodiments, the gasification agent is provided in suitable form and quantity to generate the fluidisation within the fluidized bed zone.

In certain embodiments, operation of the gasifier also comprises a step of cooling at least a portion of the product produced in step (e) (of the method describing the subzones above, referred to below as "subzone steps") to a temperature lower than the temperature in step (e), the temperature being no greater than about 200 °C below the ash softening temperature of the feedstock, wherein this step takes place in the post-gasification zone. In certain embodiments, the cooling step takes place in a quench subzone of the post-gasification zone and the step of cooling is performed using quench water or process condensate. In certain embodiments the cooling step takes place in a subzone above subzone step (d) in the post-gasification zone. In certain embodiments, the cooling step takes place at the top of the post-gasification zone and at the top of the gasifier. In certain embodiments, the quench water or process condensate is injected using a nozzle, optionally wherein the nozzle is located within the quench subzone. In certain embodiments, the temperature in this step is 200 to 300 °C below the ash softening temperature of the feedstock, optionally 200 to 250 °C below the ash softening temperature of the feedstock. In certain embodiments, the subzone is cooled through the addition of the quench water or process condensate, optionally wherein no further additional external cooling source is used. This steps quenches the raw syngas in the post-gasification zone, thus freezing or quenching sticky particles that were formed in the higher temperatures of the process, and thereby minimize the relevant problems mainly including clogging in downstream process equipment, which thus increases the gasifier availability. Thus, due to a high temperature and the possibility of melting the inorganic material in the entrained char such as alkali chloride and metal oxides, the raw syngas is subjected to the quench subzone so as to minimize the agglomeration problems or deposition of melted materials on the walls in the post-gasification region and downstream units such as the cyclone and raw gas cooler In certain embodiments, the process further comprises a further step of removing at least a portion of a bottom product, such as a heavy solid residue, produced in subzone step (b) to a sedimentation subzone in the fluidized bed zone. In certain embodiments, the process further comprises treating the bottom product in the sedimentation subzone with a gasification agent comprising steam and/or $CO_2$. In certain embodiments, the gasification agent comprises steam, in further embodiments the gasification agent is steam. In certain embodiments, the treatment is carried out at a temperature lower than the temperature in step (b), the temperature being not greater than about 400 °C below the ash softening temperature of the feedstock. In certain embodiments, the temperature is between about 400 °C to 500 °C below the ash softening temperature of the feedstock. In certain embodiments, this step takes place in a subzone below subzone step (b). In certain embodiments, this step takes place at the bottom of the fluidized bed zone and at the bottom of the gasifier. In certain embodiments, the gasification agent is injected into this subzone in a form and quantity (in a controlled manner) to generate the temperature and the required fluidisation within this subzone i.e., no other external heat source is used. In certain embodiments, the bottom product, for example a heavy solid residue, is removed from the gasifier via the bottom of the fluidized bed zone. In certain embodiments, the bottom product is treated in a bottom product removal unit, optionally comprising one or more of an intercooled screw conveyor and/or a moving bed. In certain embodiments, the process comprises recycling at least a portion of the bottom product to the pressurization unit. In certain embodiments, the apparatus comprises a return line between the bottom product removal unit and the pressurization unit, the return line being configured to recycle at least a portion of the bottom product to the pressurization unit. In certain embodiments, the return line is connected directly between the bottom product removal unit and the pressurization unit. In alternative embodiments, the bottom product is treated in at least one lock hopper before being recycled such that the return line is connected directly between the at least one lock hopper and the pressurization unit. In certain embodiments, at least a portion of the bottom product is sent to the cement industry to be reused. In certain embodiments, at least a portion of the bottom product is sent to an auxiliary boiler, optionally to be used in the production of steam.

In certain embodiments, the process comprises the quenching step and bottom product removal step in addition to subzone steps (b) to (e), which all take place in different thermal subzones. In an embodiment the gasifier comprises six thermal subzones, three within the fluidized bed zone and three within the post-gasification zone.

It will be understood by the person skilled in the art that in certain embodiments the temperature ranges referred to in the above paragraphs in relation to the steps and/or subzones which take place within the gasifier relate to average temperatures within each step and/or subzone and that the temperature may actually be higher and/or lower in certain parts of each step and/or subzone. The use of the term "average temperature" herein takes it usual meaning within the art and refers to the average temperature of each step and/or subzone and it will be understood that within each step and/or subzone there higher/lower temperatures than the average will likely be present.

For the avoidance of doubt, in alternative embodiments the temperature ranges expressed herein may refer to absolute temperature ranges rather than average temperature ranges.

In certain embodiments the fluidized bed zone has a residence time of at least about 8 minutes. In certain embodiments, the residence time is about 8 minutes to about 90 minutes, optionally about 15 minutes to about 75 minutes, optionally about 25 minutes to about 60 minutes, optionally about 35 minutes to about 45 minutes.

In certain embodiments the post-gasification zone has a residence time of at least about 7 seconds, optionally at least about 10 seconds, optionally at least about 12 seconds, optionally at least about 15 seconds. In certain embodiments, the residence time in the post-gasification zone is no greater than about 20 seconds, optionally no greater than about 15, optionally no greater than about 10 seconds. The higher residence times in the post-gasification zone help to improve the thermal decomposition of the heavier hydrocarbons including tars, thus helping to reduce the amount of tar present in the syngas product.

In certain embodiments, an external catalyst is not added into the system i.e., the gasifier is operated absent the addition of external (or fresh) catalyst. This means that no external catalyst is specifically added into the gasifier during operation. Instead, in the embodiment, the ash material within the feedstock is essentially used as the catalyst. In this respect, the bottom product of the present process typically contains both ash and carbon and the ash contains a lot of different materials such as aluminum, iron, nickel, etc. which act as the catalyst. This is beneficial in reducing operating costs and making the process simpler to operate because added external catalyst can get poisoned quickly (in particular from impurities present in the feedstock) as well as being difficult to handle and reuse.

The feedstock is thermochemically converted in the fluidized bed zone and post-gasification zone of the gasifier, optionally a HTW gasifier, through addition of the gasification agent under conditions as defined hereinabove. The feedstock is thermochemically converted into a raw syngas i.e., a synthesis gas product. The synthesis gas product leaves the gasifier and then undergoes downstream processing.

Downstream Processing

After the synthesis gas product has been produced in the gasifier, it is subject to various downstream processing steps in order to recover a pure or purer syngas (herein referred to as "synthesis gas"). This may include any processing steps which are aimed at purifying, removing impurities, cleaning, conditioning the synthesis gas product to be suitable for a conversion process into a synthetic product, amongst any other processing treatments known to be carried out on raw syngas.

Used herein, the term "recovering the synthesis gas" refers to downstream processing of the raw syngas, as will be readily understood in the art. Downstream processing refers generally to any of the steps which take place downstream of the gasifier with the purpose of purifying or preparing the syngas to be suitable for conversion to a synthetic product. As referred to herein a "processing system" refers to apparatus for downstream processing of the raw syngas.

In certain embodiments, downstream processing of the synthesis gas product produced in the gasifier takes place directly after the product leaves the gasifier. In alternative embodiments, there may be intermediate steps or processing carried out in between the product leaving the gasifier and entering the downstream processing stages.

In certain embodiments, downstream processing includes treatment of the synthesis gas product in at least one cyclone to remove entrained dust. As is understood in the art, dust is typically produced during gasification and in certain embodiments at least a portion of this is removed in a cyclone. In certain embodiments, the cyclone removes a majority (greater than 50 wt. percent) of entrained dust. In certain embodiments, the cyclone removes a majority (greater than 50 wt. percent) of pyrolytic fly-ash/char with a particle size greater than 10 microns. Any suitable cyclone apparatus may be used that is suitable for use in a gasification process. In certain embodiments, the cyclone comprises a return line to return/recycle the separated material (i.e., dust) directly back to the gasifier, optionally the fluidized bed zone of the gasifier. This helps to improve the carbon conversion efficiency of the system and process. In certain embodiments, the return line is positioned at the bottom of the cyclone. In certain embodiments, the synthesis gas product is treated in the cyclone directly after leaving the gasifier i.e., the cyclone is the first post-treatment step, situated directly downstream of the gasifier.

In certain embodiments, downstream processing includes treatment in at least one raw gas cooler. In certain embodiments, the at least one raw gas cooler is located directly downstream of the cyclone. Raw gas coolers are configured to cool the synthesis gas product and produce saturated steam. In certain embodiments, process water is added to act as cooling medium in the raw gas coolers in either a co-current or counter-current mode. In certain embodiments the synthesis gas product is cooled to a temperature of not lower than 250 °C. In certain embodiments, the system comprises a return line for returning at least a portion of the steam to the gasifier. In certain embodiments, the return line is connected to a superheater which superheats the steam being returned. In certain embodiments, the steam is returned to the fluidized bed zone of the gasifier and acts as a fluidization agent or as a gasification agent.

In certain embodiments, downstream processing includes treatment in at least one dry dust removal unit such as a dry dust candle filter or fly-ash/char removal unit (e.g., a unique dry dust candle filter). Dry dust candle filters are commonplace in the art. In certain embodiments, the dry dust removal unit is located directly downstream of the at least one raw gas cooler. In certain embodiments, the dry dust removal unit comprises candle filters which are designed to capture dust which can then be removed. In certain embodiments, any apparatus that is suitable to filter dry dust may be used. In alternative embodiments, the filter may be a dust filter. In certain embodiments, the dry dust removal unit comprises a return line to recycle at least a portion of the filtered dust to the densification step (i.e., to the densification unit, optionally a pelletizer unit) and/or a return line to recycle at least a portion of the filtered dry dust to the pressurizing step (i.e., to the pressurization unit, optionally a lock hopper system). In certain embodiments, the return system comprises the return line(s) and also one or more of a lock hopper and a dust removal apparatus in order to treat the removed dust prior to recycling it to the densifying and/or pressurizing steps. In certain embodiments, the return line is connected directly between the dry dust filter and the pressurization and/or densification units. In alternative embodiments, the separated dry dust is treated in a lock hopper before being recycled. In said embodiment, a lock hopper is positioned between the dry dust filter and the pressurization and/or densification units, such that the return line is connected directly between the lock hopper and the pressurization and/or densification units. The return line(s) helps to improve the carbon conversion efficiency of the system since the filtered dry dust still contains some carbon. In certain embodiments, at least 10 weight percent of the filtered dust is recycled to the densifying and/or pressurizing steps, optionally 20 weight percent, optionally 30 weight percent, optionally 40 weight percent, optionally 50 weight percent, optionally 60 weight percent, optionally 70 weight percent, optionally 80 weight percent, optionally 85 weight percent based on the total weight of dust filtered from the synthesis gas product. In certain embodiments, at least a portion of the filtered dust is removed and sent to the cement industry for further use.

In certain embodiments, downstream processing includes treatment in a quenching and scrubbing unit. In certain embodiments, the quenching and scrubbing unit is located directly downstream of the dry dust removal unit. In certain embodiments, the synthesis gas product is quenched, saturated, scrubbed and conditioned in the quenching and scrubbing unit. In certain embodiments, the quenching and scrubbing unit comprises a quencher unit and a scrubbing unit. Any suitable apparatus may be used that is capable of quenching and scrubbing the synthesis gas product. In certain embodiments, the quencher comprises an immersion cooler. In certain embodiments, the synthesis gas product that enters the quencher has a temperature of between about 150-400 °C. In certain embodiments, the synthesis gas product is contacted with alkaline water having a pH of between about 8 and 11. In certain embodiments the synthesis gas product is quenched and saturated in the quencher. In certain embodiments, the synthesis gas product is treated in the quencher and subsequently in the scrubbing unit. In certain embodiments, the quenched synthesis gas product is contacted with alkaline water having a pH of between about 8 and 11 in the scrubbing unit, optionally to remove impurities such as fine particles, heterocyclic aromatic compounds, where other contaminants including $H_2S$, COS, $NH_3$, HCN, etc. In certain embodiments, the synthesis gas product leaves the quenching and scrubbing units having an almost zero HCl content, such as less than 1 wt percent, optionally less than 0.1 wt percent, optionally less than 0.01 wt percent, optionally less than 0.001 wt percent, optionally zero wt percent based on the total weight of the synthesis gas product. In certain embodiments, the synthesis gas product is treated in the scrubbing unit such that it leaves the scrubbing unit having a temperature of not greater than about 250 °C.

In certain embodiments, downstream processing includes adjusting the ratio of components in the synthesis gas product. In certain embodiments, this takes place in a CO shift reactor. In certain embodiments, adjusting the ratio of components comprises adjusting the $H_2$ and CO concentration within the synthesis gas product, for example, to better prepare the product for later conversion into a synthetic product. In certain embodiments, the adjusting step takes place directly downstream of the quenching and scrubbing unit. In certain embodiments, the synthesis gas product is treated in a heat exchanger prior to entering the CO shift reactor in order to adjust its temperature. In certain embodiments steam is added to the synthesis gas product prior to it entering the CO shift reactor in order to optimize the water content. In certain embodiments, a Co—Mo—K catalyst is used in the CO shift reactor in order to adjust the CO and $H_2$ concentration of the synthesis gas product. In certain embodiments, the synthesis gas product exits the CO shift reactor having a temperature of not greater than about 450 °C. In certain embodiments, directly downstream of the CO shift reactor, the synthesis gas product is treated in a COS (carbonyl sulfide) hydrolysis reactor where other sour gas impurities such as HCN and COS are transformed into $NH_3$ and $H_2S$. In certain embodiments, the adjusted synthesis gas product exits the COS hydrolysis unit at a temperature not greater than about 200 °C. In certain embodiments, directly downstream of the COS hydrolysis reactor the synthesis gas product is treated in plurality of knockout drums in order to knock out water, $NH_3$, additional heavy hydrocarbons and metals.

In certain embodiments, downstream processing includes treating the synthesis gas product in an activated mercury guard bed. In certain embodiments, this step takes place directly downstream of the adjusting step.

In certain embodiments, downstream processing includes separating at least a portion of $CO_2$ from the synthesis gas product in at least one $CO_2$ separation unit. In certain embodiments, this step takes place directly downstream of the activated mercury guard bed. In certain embodiments, at least 5 weight percent of $CO_2$ is separated from the synthesis gas product in the $CO_2$ separation unit, optionally at least 10 wt percent, optionally at least 20 wt percent, optionally at least 30 wt percent, optionally at least 40 wt percent, optionally at least 50 wt percent, optionally at least 60 wt percent, optionally at least 70 wt percent, optionally at least 80 wt percent, optionally at least 90 wt percent, optionally at least 95 wt percent, optionally at least 99 wt percent, based on the total weight of $CO_2$ present in the synthesis gas product.

In certain embodiments, the system comprises a return line between the at least one $CO_2$ separation unit and the pressurization unit (e.g., at least one lock hopper) and a second return line between the at least one $CO_2$ separation unit and the gasifier (e.g., the fluidized bed zone thereof), the return lines being configured to recycle at least a portion of the separated $CO_2$ to the pressurization unit and gasifier. Therefore, in this embodiment there are at least two separate return lines, although they may start out as a single return line which branches off into two return lines, and therefore different portions of $CO_2$ are returned to the pressurization unit and gasifier. In certain embodiments, the return lines are located directly between the at least one $CO_2$ separation unit and the pressurization unit and gasifier i.e., there are no other units located in between the at least one $CO_2$ separation unit and the pressurization unit and gasifier. In such an embodiment, the process comprises recycling $CO_2$ directly to the pressurization unit and to the gasifier from the $CO_2$ separation unit. In certain embodiments, there is at least one unit located along the return lines between the $CO_2$ separation unit and the pressurization unit and gasifier.

In certain embodiments, at least 5 weight percent of $CO_2$ is recycled to the pressurization unit and gasifier in total, optionally at least 10 wt percent, optionally at least 20 wt percent, optionally at least 30 wt percent, optionally at least 40 wt percent, optionally at least 50 wt percent, optionally at least 60 wt percent, optionally at least 70 wt percent, optionally at least 80 wt percent, optionally at least 90 wt percent, optionally at least 95 wt percent, optionally at least 99 wt percent based on the total weight of $CO_2$ separated from the synthesis gas product. In certain embodiments, the process comprises contacting the feedstock with the recycled $CO_2$ in the gasifier i.e., the recycled $CO_2$ functions as a gasification agent in the gasifier. In certain embodiments, the recycled $CO_2$ functions as a pressurizing agent in the pressurization unit. In certain embodiments, the material being recycled from the $CO_2$ separation unit to the pressurization unit and gasifier comprises at least 50 weight percent $CO_2$, optionally at least 60 wt percent, optionally at least 70 wt percent, optionally at least 80 wt percent, optionally at least 90 wt percent, optionally at least 95 wt percent, optionally at least 99 wt percent based on the total weight of the material being recycled from the at least one $CO_2$ separation unit.

In certain embodiments the at least one $CO_2$ separation unit comprises an acid gas removal and tar wash unit. In certain embodiments, acid gas removal and tar wash unit is located directly downstream of the activated mercury guard bed. In certain embodiments, this step comprises use of an absorption agent such as cold methanol to clear the tar content of the synthesis gas product. In certain embodiments, acid gas is removed from the unit, the removed acid gas comprising a majority (i.e., at least 50 wt percent based on the total weight of the removed acid gas) of $CO_2$ and $H_2S$.

In certain embodiments, the at least one $CO_2$ separation unit comprises a $CO_2$ and $H_2S$ separation unit, optionally in addition to the acid gas removal and tar wash unit. In certain embodiments, the removed acid gas is subsequently treated in the at least one $CO_2$ and $H_2S$ separation unit. In certain embodiments, the $CO_2$ and $H_2S$ separation unit separates at least a portion of sulfur cake, which is removed from the system. In certain embodiments, the $CO_2$ and $H_2S$ separation unit separates $CO_2$ from the removed acid gas.

In certain embodiments, the at least one $CO_2$ separation unit further comprises a $CO_2$ compression unit, optionally in addition to the acid gas removal and tar wash unit and the $CO_2$ and $H_2S$ separation unit. In certain embodiments, the $CO_2$ compression unit is configured to compress at least a portion of the separated $CO_2$, optionally after having been treated in the acid gas removal and tar wash unit followed by the $CO_2$ and $H_2S$ separation unit. In certain embodiments, the recycle lines are located directly between the $CO_2$ compression unit and the pressurization unit and gasifier. In alternative embodiments, the recycle lines are located directly between the $CO_2$ and $H_2S$ separation unit and the pressurization unit and gasifier.

In certain embodiments, the cleaned synthesis gas exits $CO_2$ separation unit, in particular the acid gas removal and tar wash unit, and is passed through a pressure booster unit, optionally as a final step in the downstream processing, to elevate the pressure of the synthesis gas optionally to at least 10000 kPa (optionally from a previous pressure of at least 5000 kPa).

As explained in more detail hereinbefore, the recycling of the $CO_2$ to the pressurization unit and gasifier helps to improve the carbon conversion efficiency of the system.

In certain embodiments, after recovering the synthesis gas from the downstream processing steps, the synthesis gas can be further processed into any useful synthetic product and/or chemical that is typically prepared from synthesis gas. In certain embodiments, the synthesis gas is converted into a synthetic product such as a synthetic fuel or chemical in accordance with any known syngas conversion method or technique known in the field e.g., Fischer-Tropsch conversion. These products may be described as renewable synthetic products, or renewable synthetic fuels and chemicals. Examples of such synthetic products are bio-methanol, synthetic natural gas and/or Fischer-Tropsch synthesis fuels.

In certain embodiments, converting the synthesis gas to more useful synthetic products such as synthetic fuels includes reusing offgas that is produced during the conversion of the synthesis gas to the synthetic product, by converting the offgas into synthesis gas and returning the synthesis gas to the step of converting the synthesis gas to the synthetic fuel. Such a method is explained in DE 102013103356 A1. During the conversion to synthetic product, offgas or exhaust gas containing components such as carbon monoxide, hydrogen, methane and higher hydrocarbons is removed and then processed in a separate processing unit, such as an autothermal reformer (ATR) to convert this offgas back into pure synthesis gas. This pure synthesis gas can then be returned for conversion to the synthetic product, which thus helps to improve the overall conversion efficiency of the process.

Successful tests have been conducted based on the process and apparatus described herein. The feedstocks tested were included the following: i) waste wood pellet (WW), ii) 75% RDF/25% WW, iii) 50% RDF/50% WW, (iv) 25% RDF/75% WW and v) 100% RDF. The tests showed efficient conversion of the feedstock to synthesis gas, with a carbon conversion efficiency (CCE) of approximately 95% (wherein CCE represents the percentage of total carbon in the gasifier feedstock which is successfully converted to product gases, which contain carbon (such as CO, $CO_2$, $CH_4$, $C_2H_2$, $C_2H_4$, $C_2H_6$, $C_6H_6$ and $C_{10}H_8$)).

Figure 2:
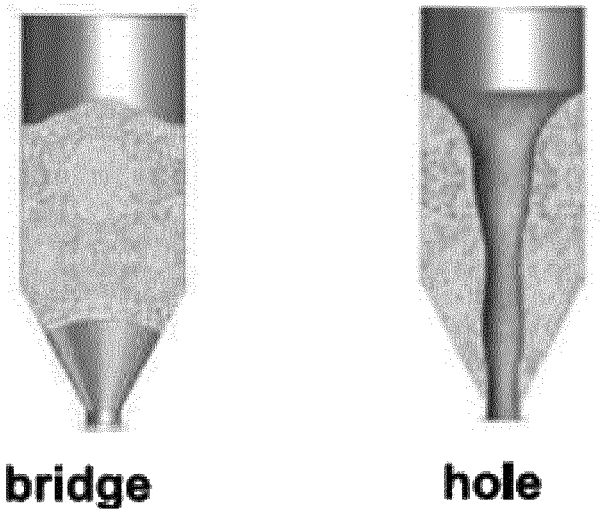
FIG. 2 shows two cross sections of lock hoppers used for pressurizing solid feedstocks. If the feedstock is not pelletised, the feedstock can form bridges (left-handed picture) or holes (right-handed picture).

It was surprisingly found that, due to the use of densified feedstock comprising biomass and/or carbon-containing solid waste material in the form of pellets for the present HTW gasification process, said feedstock is introduced into the gasifier in a simpler manner. Without wishing to be bound by a particular theory, it is assumed that this effect is achieved due to avoidance of hindrances, such as bridges and holes as shown in FIG. 2, in the feeding line. With the densification of the feedstock, such as pelletisation, the density of the feedstock is increased from approx. 150 kg/$m^3$ (fluff stage) to approx 450-550 kg/$m^3$ (pellets stage). By this the gas (usually $CO_2$) required for pressurisation of the feedstock in the lock hopper system is significantly reduced and this has a very positive effect on the gasification process inside the HTW reactor.

In addition, densification of waste/biomass offers higher carbon-density and also higher energy density in feedstock, thereby offering higher flowrate of effective syngas, i.e. $CO+H_2$, being matched with the higher design capacity for a bio-fuel production route. Particularly, it has been found out by the inventors with respect to densified feedstock comprising biomass and/or carbon-containing solid waste material in the form of pellets as used within the present invention, that the chemical energy is preserved after this pretreatment compared to other pretreatment routes. There are the main pre-treatment routes for industrial scale production of bio-fuels via pressurised gasification process for which the inventors surprisingly found out that: (1) pellets where 100% of original chemical energy of the feedstock is processed in the gasifier; (2) torrefaction, where only 87% of original chemical energy of the feedstock is processed in the gasifier, the rest is lost in the torrefaction process; and (3) pyrolysis, where approx. 70% of original chemical energy of the feedstock is processed in the gasifier, the rest is lost in the pyrolysis process. Therefore, using pellets for a feedstock as described herein is advantageous in terms of exploiting chemical energy for the gasification.

Furthermore, it has been surprisingly found that, by using densification of the feedstock in the aforementioned test conducted, the overall energy required for pelletisation and the subsequent gasification at elevated pressure, e.g. above 10 bar, and syngas compression is less than the energy required for gasification at atmospheric pressure and pressurizing the syngas from atmospheric pressure to the pressure of bio-fuel synthesis.

The order of the steps of the processes described herein is exemplary (unless a certain order is necessitated through the explicit wording of the steps), but the steps may be carried out in any suitable order, or simultaneously where appropriate. Additionally, steps may be added or substituted in, or individual steps may be deleted from any of the processes without departing from the scope of the subject matter described herein. For example, even if in the claims herein a second step follows a first step, it is to be understood that further steps may be carried out in between the first and second steps in accordance with the general knowledge of the art—unless if the wording of the claim explicitly requires there to be no intervening steps.

It will be understood that the description of preferred embodiments herein is given by way of example only and that various modifications may be made by those skilled in the art. What has been described above includes examples of one or more embodiments. It is, of course, not possible to describe every conceivable modification and alteration of the above process and apparatus for purposes of describing the aforementioned aspects, but one of ordinary skill in the art can recognize that many further modifications and permutations of various aspects are possible. Accordingly, the described aspects are intended to embrace all such alterations, modifications, and variations that fall within the scope of the appended claims.

The invention claimed is:

1. A process for converting feedstock comprising biomass and/or carbon-containing solid waste material to synthesis gas, the process comprising the following steps:

(a) densifying the feedstock;

(b) pressurizing the feedstock from step (a) in a pressurization unit;

(c) supplying the feedstock from step (b) to a gasifier, the gasifier comprising a fluidized bed zone and a post-gasification zone;

(d) converting the feedstock from step (c) to a synthesis gas product by contacting the feedstock with a gasification agent in the gasifier; and (e) recovering the synthesis gas from the product produced in step (d), wherein recovering the synthesis gas comprises separating at least a portion of $CO_2$ from the product produced in step (d) and recycling at least a first portion of the separated $CO_2$ to the pressurization unit and recycling at least a second portion of the separated $CO_2$ to the gasifier, wherein recovering the synthesis gas further comprises filtering dust from the product in a dry dust removal unit, further comprising recycling at least a portion of the filtered dry dust to step (a) and/or recycling at least a portion of the filtered dry dust to step (b).

2. The process of claim 1, wherein step (d) comprises contacting the feedstock with the gasification agent in the fluidized bed zone at an average temperature of between about 250-500 °C below the ash softening temperature of the feedstock, to partially oxidize the feedstock.

3. The process of claim 2, wherein step (d) comprises contacting the partially oxidized feedstock with the gasification agent in the post-gasification zone at an average temperature of between about 150-300 °C below the ash softening temperature of the feedstock.

4. The process of claim 1, further comprising operating the fluidized bed and post-gasification zones at a pressure of between about 200 kPa to about 3000 or between about 200 kPa to about 4000 kPa.

5. The process of claim 1, wherein densifying the feedstock in step (a) takes place in a densification unit and comprises pelletizing the feedstock in a pelletizer unit.

6. The process of claim 1, wherein recovering the synthesis gas further comprises:

(e1) dry filtering and cleaning the synthesis gas product produced in step (d);

(e2) quenching, saturating, scrubbing, and conditioning a product of step (e1); and (e3) treating a product of step (e2) to adjust the ratio of components in the product.

7. The process of claim 6, wherein the product of step (e1) entering the quenching and saturating steps has a temperature of at least 150 °C and not greater than 400 °C.

8. The process of claim 6, wherein the quenching and saturating comprises contacting the product of step (1) with alkaline water having a pH of between about 8 to 11.

9. The process of claim 6, wherein the product of step (e2) has a zero chloride content and has a temperature not greater than about 250 °C.

10. A process for converting feedstock comprising biomass and/or carbon-containing solid waste material to a synthetic product and/or chemical, the process comprising:

converting feedstock comprising biomass and/or carbon-containing solid waste material to synthesis gas according to the process of claim 1; and converting the synthesis gas to the synthetic product and/or chemical.

11. The process of claim 10, further comprising:

converting the offgas produced during the conversion of the synthesis gas to the synthetic product and/or chemical into synthesis gas; and returning the synthesis gas to the step of converting the synthesis gas to the synthetic product and/or chemical.

12. The process of claim 1, wherein the gasifier is a High Temperature Winkler (HTVV) gasifier or a refractory lined reactor.

13. The process of claim 1, wherein the gasification agent comprises steam, oxygen and $CO_2$.

14. The process of claim 1, wherein the pressure of the fluidized bed and post-gasification zones is between about 1000 kPa to about 3000 or between about 1000 kPa to about 4000 kPa.

15. Apparatus for converting feedstock comprising biomass and/or carbon-containing solid waste material to synthesis gas, the apparatus comprising:

a feeding system comprising a densification unit configured to densify the feedstock and a pressurization unit configured to pressurize the feedstock;

a gasifier comprising a fluidized bed zone and a post-gasification zone configured to thermally convert the feedstock to a synthesis gas product, wherein the feeding system is configured to transport the feedstock to the gasifier; and a processing system downstream of the gasifier configured to recover the synthesis gas from the synthesis gas product, wherein the processing system comprises at least one $CO_2$ separation unit configured to separate $CO_2$ from the synthesis product;

wherein the processing system further comprises a return line between the at least one $CO_2$ separation unit and the pressurization unit and a second return line between the at least one $CO_2$ separation unit and the gasifier, the return lines being configured to recycle at least a portion of the separated $CO_2$ to the pressurization unit and gasifier, wherein the fluidized bed and post-gasification zones are configured to be operated at a pressure of between about 200 kPa to about 4000 kPa, and wherein the processing system further comprises a dry dust removal unit configured to filter dust from the synthesis gas product and a return line between the dry dust removal unit and the densification unit and/or the pressurization unit, the return line being configured to recycle at least a portion of the filtered dust to the densification unit and/or pressurization unit.

16. The apparatus of claim 15, wherein the gasifier is a High Temperature Winkler (HTVV) gasifier.

17. The apparatus of claim 15, wherein the pressure of the fluidized bed and post-gasification zones is between about 1000 kPa to about 3000 or between about 1000 kPa to about 4000 kPa.

* * * * *